US007900414B2

(12) United States Patent
Seccombe

(10) Patent No.: US 7,900,414 B2
(45) Date of Patent: Mar. 8, 2011

(54) CLADDING SHEET

(75) Inventor: John Campbell Seccombe, Turramurra (AU)

(73) Assignee: Bluescope Steel Limited, Melbourne (AU)

( * ) Notice: Subject to any disclaimer, the term of this patent is extended or adjusted under 35 U.S.C. 154(b) by 360 days.

(21) Appl. No.: 11/993,597

(22) PCT Filed: Jun. 21, 2006

(86) PCT No.: PCT/AU2006/000870

§ 371 (c)(1),
(2), (4) Date: Jan. 22, 2008

(87) PCT Pub. No.: WO2006/135972

PCT Pub. Date: Dec. 28, 2006

(65) Prior Publication Data

US 2010/0047608 A1 Feb. 25, 2010

(30) Foreign Application Priority Data

Jun. 21, 2005 (AU) ..... 2005903254

(51) Int. Cl.

| | |
|---|---|
| ***E04C 2/08*** | (2006.01) |
| ***E04C 2/32*** | (2006.01) |
| ***E04C 2/38*** | (2006.01) |
| ***E04D 3/24*** | (2006.01) |
| ***E04D 3/30*** | (2006.01) |

(52) U.S. Cl. ..... 52/478; 52/489.1; 52/520; 52/521; 52/522; 52/529; 52/530; 52/531; 52/539; 52/588.1; 52/592.1

(58) Field of Classification Search ..... 52/478, 52/512, 520, 522, 529–531, 535–537, 588.1, 52/592.1, 798.1, 630, 489.1, 521, 539
See application file for complete search history.

(56) References Cited

U.S. PATENT DOCUMENTS

| | | | | | |
|---|---|---|---|---|---|
| 2,077,162 | A | * | 4/1937 | Ansel | 52/520 |
| 2,128,495 | A | * | 8/1938 | Murphy | 52/520 |
| 2,178,415 | A | * | 10/1939 | Ansel | 52/520 |
| 3,253,375 | A | * | 5/1966 | Takehara | 52/478 |
| 3,303,625 | A | * | 2/1967 | Furrer | 52/520 |
| 3,590,543 | A | * | 7/1971 | Heirich | 52/298 |
| 3,606,718 | A | * | 9/1971 | Elizalde | 52/542 |
| 3,812,636 | A | * | 5/1974 | Albrecht et al. | 52/334 |
| 3,852,929 | A | * | 12/1974 | Cookson | 52/543 |

(Continued)

FOREIGN PATENT DOCUMENTS

AU 20744/92 B 2/1993

(Continued)

OTHER PUBLICATIONS

PCT/AU2006/000870 International Search Report.

*Primary Examiner* — Robert J Canfield
(74) *Attorney, Agent, or Firm* — Michael Best & Friedrich LLP

(57) ABSTRACT

A cladding sheet that is adapted to engage one or more than one concealed clip that is connected to an underlying structure is disclosed. The cladding sheet includes at least one lengthwise extending pan (3) and a lengthwise extending rib (5) on each side of the pan. The width of each rib is between 70% and 130% of the width of the pan.

5 Claims, 3 Drawing Sheets

U.S. PATENT DOCUMENTS

| | | | | | |
|---|---|---|---|---|---|
| 3,884,328 | A | * | 5/1975 | Williams | 182/222 |
| 3,906,696 | A | * | 9/1975 | Poter et al. | 52/536 |
| 3,984,959 | A | * | 10/1976 | Wasson | 52/506.07 |
| 4,144,369 | A | * | 3/1979 | Wass | 428/183 |
| 4,285,182 | A | * | 8/1981 | Dinges | 52/478 |
| 4,400,922 | A | * | 8/1983 | Boyer | 52/394 |
| 4,406,106 | A | * | 9/1983 | Dinges | 52/478 |
| 4,453,364 | A | | 6/1984 | Ting | |
| 4,466,224 | A | * | 8/1984 | Hague | 52/478 |
| 4,486,998 | A | * | 12/1984 | Hague | 52/478 |
| 4,505,084 | A | * | 3/1985 | Knudson | 52/528 |
| 4,517,782 | A | | 5/1985 | Shamszadeh | |
| 4,545,172 | A | | 10/1985 | Wardill | |
| 4,580,384 | A | * | 4/1986 | Hutcheson | 52/537 |
| 4,675,238 | A | * | 6/1987 | Karoubas | 428/599 |
| 4,809,479 | A | * | 3/1989 | Tierno et al. | 52/588.1 |
| 5,507,126 | A | | 4/1996 | Wu | |
| 5,524,409 | A | * | 6/1996 | Kaiser | 52/588.1 |
| 5,636,488 | A | * | 6/1997 | Lawrence et al. | 52/521 |
| 5,752,355 | A | * | 5/1998 | Sahramaa | 52/539 |
| 6,050,030 | A | * | 4/2000 | Wax, Sr. | 52/15 |
| 6,543,197 | B2 | * | 4/2003 | Wetzel et al. | 52/581 |
| 6,941,707 | B2 | * | 9/2005 | Sigmund | 52/95 |

FOREIGN PATENT DOCUMENTS

| | | | | |
|---|---|---|---|---|
| AU | 97099/01 | B2 | | 6/2002 |
| DE | 4040215 | A1 | | 6/1992 |
| DE | 41 25 900 | A1 | * | 2/1993 |
| EP | 1454957 | | * | 11/1976 |
| GB | 2245618 | A | | 1/2008 |
| WO | 2006/135972 | A1 | * | 12/2006 |

* cited by examiner

CLADDING SHEET

The present invention relates to metal cladding sheets.

The present invention relates particularly, although by no means exclusively, to metal cladding sheets that are adapted to be held to an underlying structure, such as a roof frame, by concealed clips that are connected to the underlying structure.

The present invention relates more particularly, although by no means exclusively, to roof cladding sheets that are adapted to be held to an underlying roof frame by concealed clips that are connected to the underlying structure.

Metal cladding sheets are used in a wide range of applications in the building and the construction industries. In building applications, the sheets are often used in roofing and walling and as infill panels in fencing. In construction applications, the sheets are often used in reinforced concrete floor and wall slabs. Whilst there are similarities in the basic construction of metal cladding sheets generally, the different applications in which the sheets can be used often calls for particular structural requirements for the sheets to suit the applications. As a consequence, persons skilled in the art categorise metal cladding sheets in terms of the applications in which the sheets are used and, by way of example, would not generally look at metal cladding sheets that are suitable for roofing applications as suitable for use in reinforced concrete floor and wall slab applications and vice versa.

Metal cladding sheets are often made from steel strip that is cut into discrete lengths to form the individual sheets.

To provide adequate strength to the sheets, the metal strip is often profiled to include linear stiffening formations such as ribs, pleats or corrugations. This profiling is typically achieved by cold working the metal strip in a roll-forming operation.

One type of metal cladding sheet that is formed from metal strip is made from steel which is coated with a corrosion resistant metal coating formed typically from zinc or an aluminium-zinc alloy. In addition, a decorative coating, such as a paint coating, may be applied to one surface, or in some cases both surfaces, of the strip. A sheet steel strip incorporating a Zn—Al coating and a paint overlay is sold by the applicant under the trade mark COLORBOND®.

It is known to secure cladding sheets to an underlying structure by using clips that are connected to the structure by fasteners and are formed to extend into the ribs and include retaining members or tabs that can engage re-entrant sections of the ribs and thereby retain the sheets to the clips. These clip assemblies are often preferred over nails or other fasteners because they enable concealed fixing of cladding sheets to an underlying structure.

In use, the concealed retaining clips are connected to an underlying structure at spaced intervals related to the spacing between the ribs of the cladding sheets. Thereafter, cladding sheets are positioned on the clips in side by side overlapping relationship by successively pressing the sheets down onto the clips so that the sides of the ribs are initially forced outwardly to allow re-entrant sections of the ribs to pass over the retaining members and then snap inwardly and engage with the retaining members.

The applicant has investigated the response of conventional roof cladding sheets to the action of wind pressure against the sheets and, more particularly, the uplift capacity of the sheets i.e. the capacity of the sheets to resist disengagement from concealed clips caused by wind pressure. Generally, this engagement is caused by the sides of the ribs rotating outwardly away from the retaining members of the clips in response to wind pressure.

The applicant has found that pan deflection is a limiting factor to uplift capacity.

Specifically, the applicant has found that pans bow upwards under the action of wind pressure and that this upward bowing causes ribs to spread outwardly and that this outward movement eventually causes the sheets to disengage from the clips. One conclusion that follows from this finding is that limiting pan width is necessary in order to achieve reasonable uplift capacity. However, this is not a practical option for conventional cladding sheets that have relatively wide pans and relatively narrow ribs from the viewpoint of cover efficiency. Specifically, this option would result in a larger number of ribs for a given width of a conventional cladding sheet. A larger number of ribs is undesirable because cover efficiency is a function of the number of ribs—the fewer the ribs the more efficient the cover efficiency.

The present invention is based on the realisation that an alternative solution to the problem of improving uplift capacity while maintaining cover efficiency is a fundamentally different approach to the conventional design of cladding sheets.

The fundamentally different approach of the present invention involves making the ribs much wider than is the case in conventional cladding sheets.

In the course of making the invention described in the preceding paragraph, the applicant also invented a different structure of side formations for holding adjacent cladding sheets in side by side overlapping relationship.

According to the present invention there is provided a cladding sheet that is adapted to engage one or more than one concealed clip that is connected to an underlying structure, which cladding sheet includes at least one lengthwise extending pan, a lengthwise extending rib on each side of the pan, and wherein the width of each rib is between 70% and 130% of the width of the pan.

Preferably the cladding sheet is a roof cladding sheet.

The applicant has found that, when the above-described cladding sheet is used as a roof cladding sheet, rib bow of the cladding sheet in response to wind pressure will have the effect of closing the ribs, and the closing force will counteract the oppositely operating opening forces on the ribs caused by pan bow.

In addition, in the context of use of the cladding sheet as a roof cladding sheet, the relatively wide ribs of the above-described cladding sheet, compared to conventional cladding sheets, means that a relatively small number of ribs per sheet is required to achieve a minimum uplift capacity for a given width of the sheet.

Thus, the cladding sheet of the present invention makes it possible to achieve high uplift capacity without a loss of cover efficiency.

Preferably the width of each rib is between 80% and 120% of the width of the pan.

More preferably the width of each rib is between 90% and 110% of the width of the pan.

More preferably the width of each rib is substantially the same as the width of the pan.

Preferably each rib includes a top wall and a side wall that is adjacent the pan, and the side wall includes a re-entrant section that is adapted to engage and be retained by one or more than one concealed clip.

Preferably the re-entrant section is in a lower section of the side wall.

Preferably the side wall includes a first section that extends downwardly and outwardly from the top wall, a second section that extends downwardly and inwardly from a lower edge of the first section, and a third section that extends outwardly from a lower edge of the second section and merges with the pan, with the re-entrant section being defined by the above-described second section.

Preferably the cladding sheet includes side formations on opposite sides of the sheet that enable adjacent sheets to be positioned side by side in overlapping relationship.

Preferably the cladding sheet includes two parallel ribs and two parallel pans, with one rib including one side formation and thereby forming one side of the sheet, and the other rib being separated by the two pans.

Preferably the pans are the same width.

Preferably the one side formation includes a re-entrant section, such as the re-entrant section described above, adapted to engage and be retained by one or more than one concealed clip.

Preferably the one side formation further includes a channel that opens inwardly of the sheet.

Preferably the channel is positioned in a higher section of the one side formation than the re-entrant section.

Preferably the other side formation includes an in-turned lip that is formed to extend into the channel of the one side formation of an adjacent sheet when the sheets are positioned side by side in overlapping relationship and are retained by one or more than one concealed clip, whereby the assembly of the in-turned lip extending into the channel retains together the side formations and thereby contributes to holding the adjacent sheets in overlapping relationship.

According to the present invention there is also provided a cladding sheet, preferably a roof cladding sheet, that is adapted to engage one or more than one concealed clip that is connected to an underlying structure, which cladding sheet includes at least one lengthwise extending pan, a lengthwise extending rib on each of side of the pan, and side formations on opposite sides of the sheet that enable adjacent sheets to be positioned side by side in overlapping relationship, and wherein one side formation includes a re-entrant section adapted to engage and be retained by one or more than one concealed clip and a channel that opens inwardly of the sheet and is positioned in a higher section of the one side formation than the re-entrant section, and wherein the other side formation includes an in-turned lip that is formed to extend into the channel of the one side formation of an adjacent sheet when the sheets are positioned side by side in overlapping relationship and are retained by one or more than one concealed clip, whereby the assembly of the in-turned lip extending into the channel retains together the side formations and thereby contributes to holding the adjacent sheets in overlapping relationship.

Preferably the lip and the channel are formed so that, in use, the assembly of the in-turned lip and the channel is positioned above the concealed clip.

According to the present invention there is also provided a cladding assembly that includes:

(a) a plurality of concealed clips secured to an underlying structure; and (b) a plurality of the above-described cladding sheet positioned in side by side overlapping relationship retained by the concealed clips.

Preferably adjacent sheets are retained by each concealed clip with the re-entrant section of the side formation of a first laid sheet engaging and being retained by the clip and the in-turned lip of the side formation of a successively laid sheet extending into and being received by the channel of the side formation of the already-positioned sheet.

Preferably the side formation of the successively laid sheet does not engage the clip directly.

Preferably the underlying structure is a roof framework.

The present invention is described further with reference to the accompanying drawings, of which:

Figure 1:
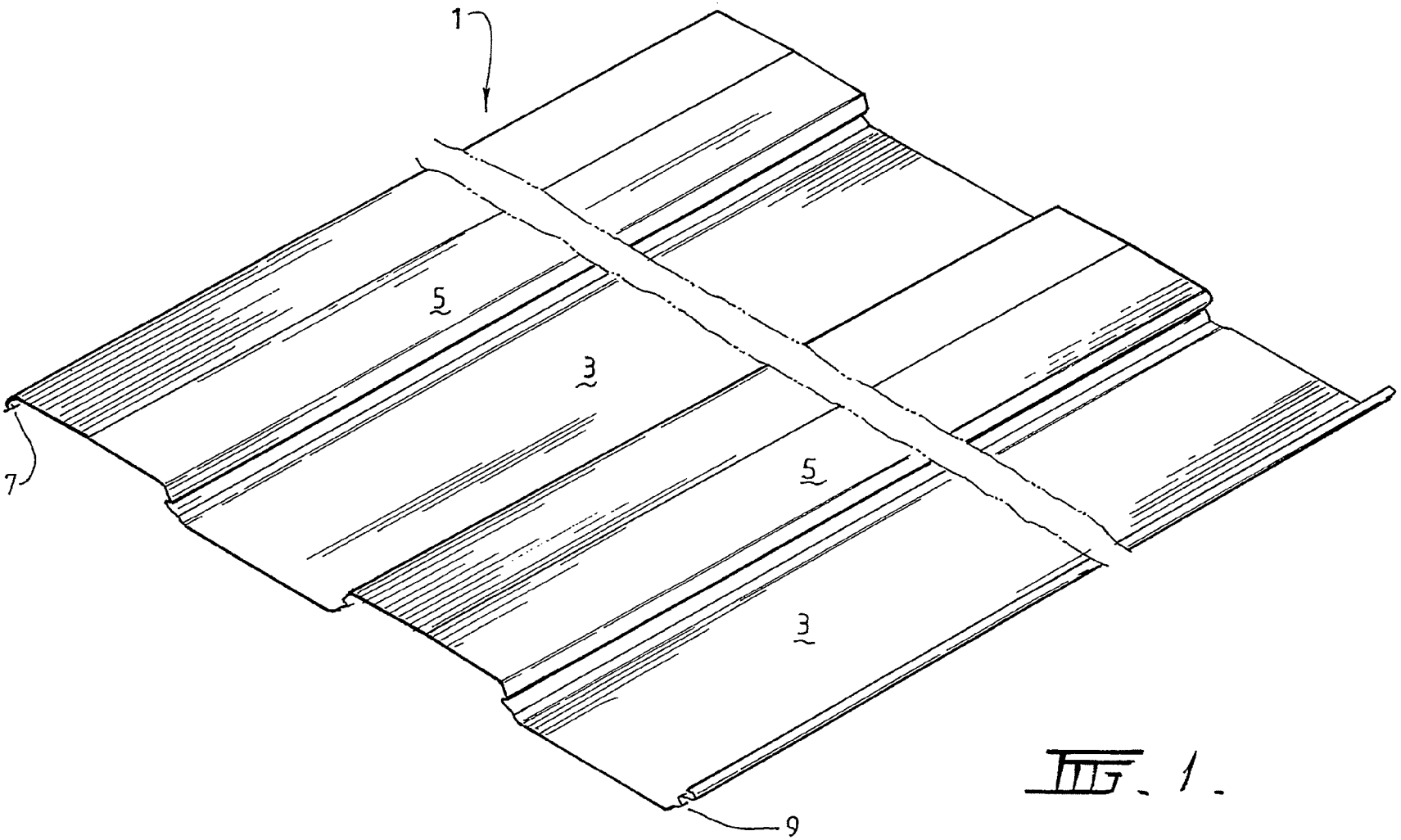
FIG. 1 is a perspective view of one embodiment of a roof cladding sheet in accordance with the present invention.
Figure 2:
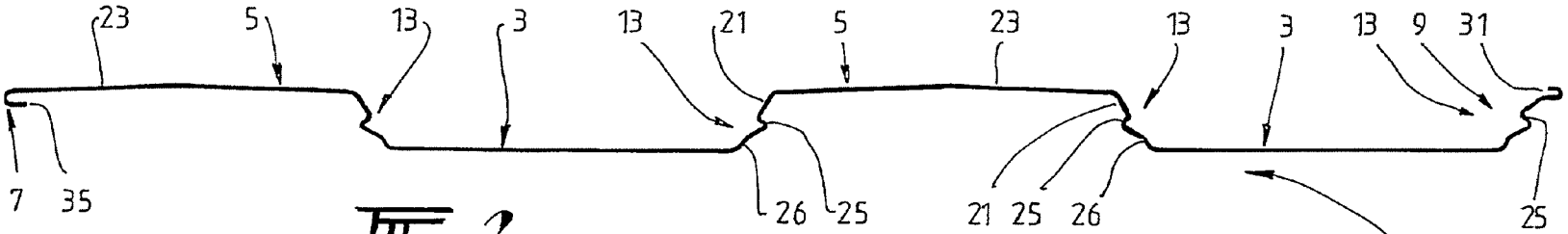
FIG. 2 is a transverse cross section through the sheet shown in FIG. 1.

The roof cladding sheet 1 shown in FIGS. 1 and 2 is roll-formed from steel strip and includes:

(a) two lengthwise extending, parallel pans 3 that are the same width;

(b) two parallel lengthwise extending ribs 5, with one rib 5 separating the pans 3 and the other rib 5 terminating at one side of the sheet, and the ribs 5 being the same width; and (c) side formations 7, 9 that allow adjacent sheets to be positioned side by side in overlapping relationship with the side formation 7 being formed as part of the rib 5.

The pans 3 are shown as flat pans. However, it is noted that the pans 3 may include stiffening formations, such as small lengthwise extending ribs (not shown).

The sheet 1 is formed with the widths of the pans 3 and the widths of the ribs 5 being selected to be substantially the same. As is indicated above, the applicant has found that this arrangement results in a substantial evening out of uplift forces on the pans 3 and the ribs 5, with the result that there is substantially no outward rotation of the ribs 5 caused by upward bowing of the pans 3 that would otherwise tend to disengage the sheet from concealed clips 11 that hold the sheet to the underlying structure (not shown).

Each rib 5 of the sheet 1 shown in FIGS. 1 and 2 includes a top wall 23 and one or two side walls, generally identified by the numeral 13.

Figure 3:
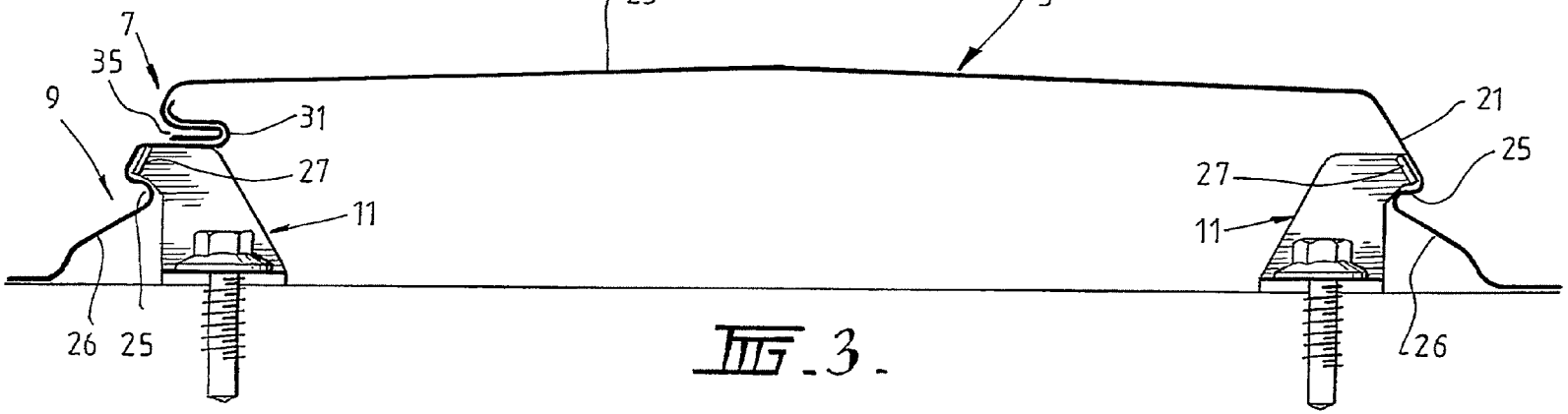
FIG. 3 is a transverse section illustrating inter-engagement of two successively laid adjacent cladding sheets shown in FIGS. 1 and 2 on concealed clips, with the Figure illustrating the sheets in the opposite direction to FIGS. 1 and 2.

The ribs 5 include re-entrant sections that facilitate engagement of the sheet 1 to concealed clips 11 as shown in FIG. 3. The re-entrant sections are formed in the side walls 13.

Each side wall 13 of a rib 5 includes a first section 21 that extends outwardly and downwardly from the top wall 23 of the rib 5, a second section 25 that extends downwardly and inwardly from a lower edge of the first section 21, and a third section 26 that extends downwardly and outwardly from a lower edge of the second section 25 and merges with the adjacent pan 3.

The second section 25 defines the re-entrant section.

FIG. 3 shows how the re-entrant sections of the ribs 5 engage concealed clips 11. With reference to FIG. 3, the concealed clips 11 shown in the Figure are representative of known clips and include retaining members in the form of flanges 27. The clips 11 are formed so that, when the clips 11 are positioned appropriately, a cladding sheet 1 can be positioned on the clips 11 by pressing the ribs 5 down on to the clips 11 and snapping the ribs 5 over the flanges 27 with the result that the re-entrant sections 25 bear against and therefore engage and are retained by the flanges 27. This is shown in FIG. 3.

With further reference to FIGS. 1 and 2, the side formation 9 on the right side of the sheet 1 shown in Figures includes an inwardly open channel 31 and a re-entrant section 25 that has the same structure as the re-entrant sections 25 of the ribs 5.

The side formation 7 shown on the left side of FIGS. 1 and 2 includes an in-turned lip 35.

As is described hereinafter and shown in FIG. 3, the channel 31 and the in-turned lip 35 are formed to co-operate to interconnect adjacent sheets 1 in side by side overlapping relationship.

FIG. 3 shows two of the sheets 1 of FIGS. 1 and 2 that have been successively laid on to an underlying support structure and engage and are retained by the concealed clips 11. The left sheet 1 is the first laid sheet of the two sheets 1 shown in the Figure.

With reference to FIG. 3, the re-entrant section 25 of the side formation 9 of the left side sheet 1 shown in the Figure enables the sheet 1 to engage and be retained by the flange 27 of the clip 11 shown at that side.

When the left side cladding sheet 1 is positioned as shown in FIG. 3, the outwardly opened channel 31 of the side formation 9 rests on a top wall of the clip 11.

The second sheet 1, i.e. the right side sheet 1, is laid by positioning the sheet 1 so that the in-turned lip 35 of the side formation 7 extends into and is retained by the outwardly opened channel 31 of the side formation 9 of the already-laid left side sheet 1. Thereafter, the adjacent rib 5 of the second sheet 1 is pressed down over the right side rib 5 shown in FIG. 3 so that the re-entrant section 25 of the rib 5 passes over the flange 27 of the clip 11 and engages and is retained by the flange 27.

The above-described arrangement is securely positioned on the underlying structure.

Figure 5:
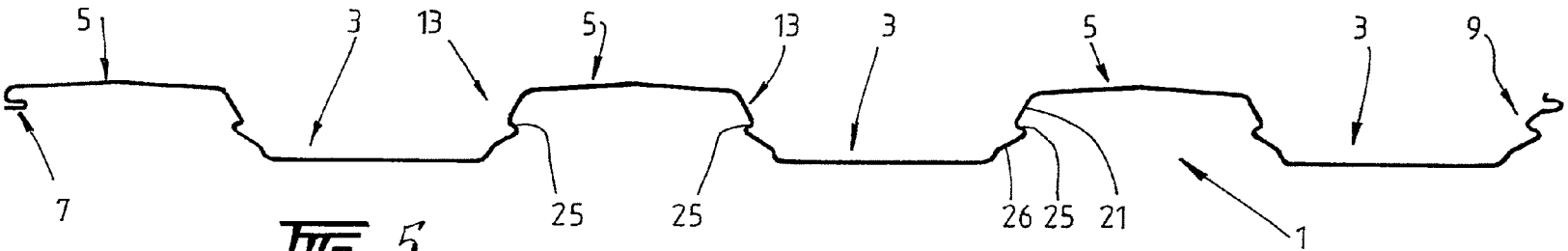
FIG. 5 is a transverse cross section through the sheet shown in FIG. 4.
Figure 4:
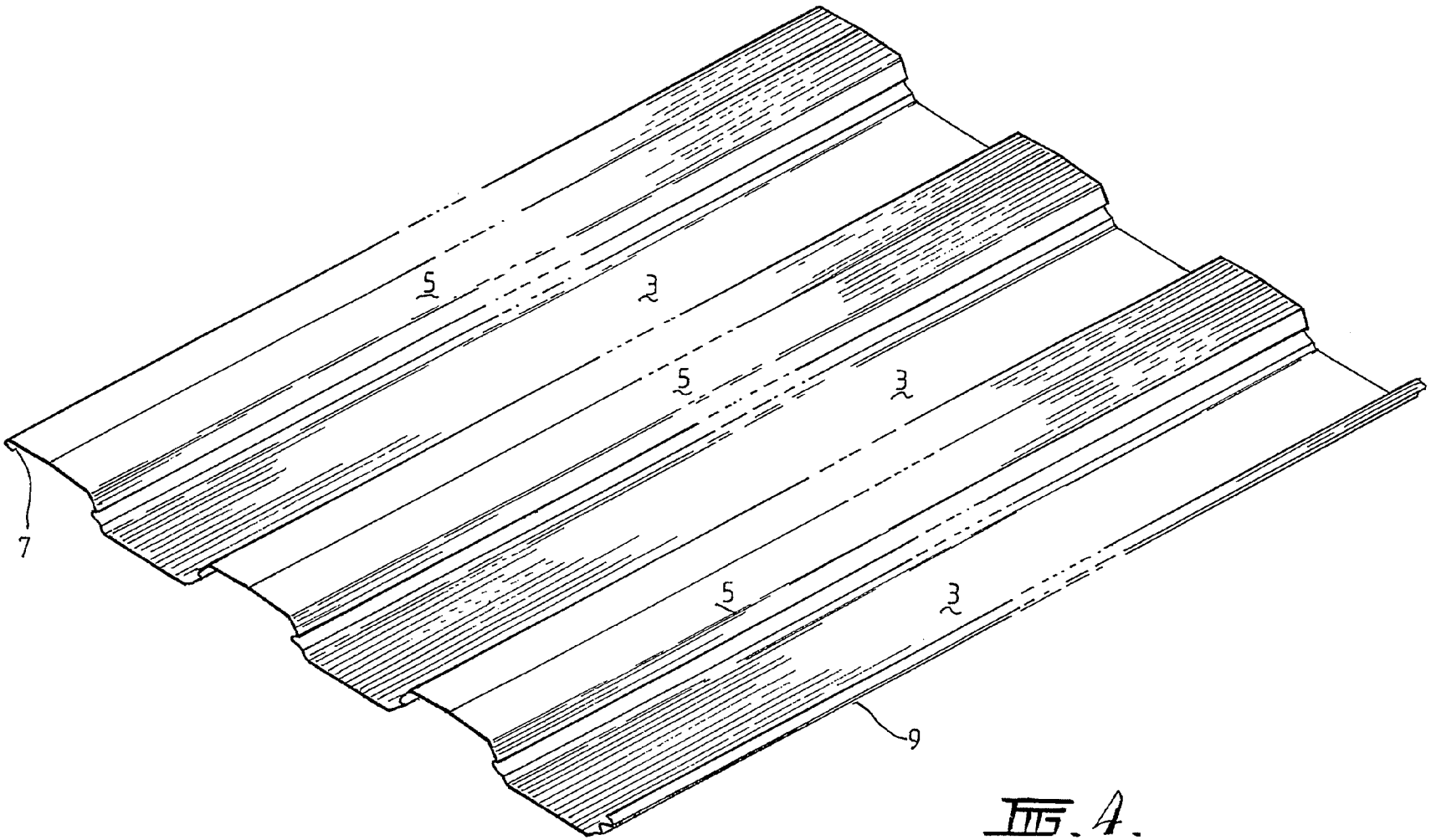
FIG. 4 is a perspective view of another, although not the only possible other, embodiment of a roof cladding sheet in accordance with the present invention.

FIGS. 4 and 5 show another embodiment of a roof cladding sheet 1 in accordance with the present invention.

The cladding sheet 1 shown in FIGS. 4 and 5 is identical to the cladding sheet 1 shown in FIGS. 1 and 2 in all material respects and the same reference numerals are used in both sets of Figures to describe the same structural features.

In particular, the side formations 7, 9 of both sets of Figures are the same and function in the same way, as shown in FIG. 3, to position adjacent sheets 1 in side by side overlapping relationship.

The only difference between the sheets 1 is that the sheet 1 shown in FIGS. 4 and 5 has three parallel, lengthwise extending pans 3 and three parallel, lengthwise extending ribs 5 and the sheet 1 shown in FIGS. 1 and 2 has only two such ribs 3 and two such pans 5.

Many modifications may be made to the embodiments of the present invention described above without departing from the spirit and scope of the present invention.

By way of example, the present invention is not limited to the cladding sheets with two/three pans 3 and two/three ribs 5 and the other detail of the sheets 1 shown in the drawings. By way of example, the cladding sheet of the present invention may have any suitable number of ribs 3 and pans 5.

The invention claimed is:

1. A cladding assembly that includes:

(a) a plurality of concealed clips secured to an underlying structure; and (b) a plurality of cladding sheets that have enhanced uplift capacity and are in side by side overlapping relationship and are retained on the underlying structure by the concealed clips, each cladding sheet including side formations on opposite sides of the sheet that engage complementary side formations on adjacent sheets and retain the sheets in side by side overlapping relationship, each cladding sheet also including at least one lengthwise extending pan and a lengthwise extending rib on each side of the pan, with each rib having a width of between 70% and 130% of the width of the pan, and wherein one side formation includes a re-entrant section that engages one concealed clip and a channel that opens inwardly of the sheet and is in a higher section of the one side formation, and wherein the other side formation forms one side of one rib and includes an in-turned lip that extends into the channel of the one side formation of an adjacent sheet, wherein the other side of the one rib includes a re-entrant section that engages one concealed clip, and the engagement of this side of the one rib with the re-entrant section ensures that the in-turned lip extends into the channel and retains together the side formations and holds the adjacent sheets in overlapping relationship.

2. The cladding assembly defined in claim 1 wherein the underlying structure is a roof framework.

3. The cladding sheet defined in claim 1 wherein the width of each rib is between 80% and 120% of the width of the pan.

4. The cladding sheet defined in claim 1 wherein the width of each rib is between 90% and 110% of the width of the pan.

5. The cladding sheet defined in claim 1 wherein the width of each rib is substantially the same as the width of the pan.

* * * * *